United States Patent [19]

Le Gall et al.

[11] Patent Number: 4,621,266

[45] Date of Patent: Nov. 4, 1986

[54] DEVICE FOR STABILIZING AND AIMING AN ANTENNA, MORE PARTICULARLY ON A SHIP

[76] Inventors: Jean C. Le Gall, Rue des Bruyéres la Clarké22700 Perros-Guirec; Bernard Mathieu, Kergoustalen-Rospez, 22300-Lannion, both of France

[21] Appl. No.: 650,183

[22] Filed: Sep. 13, 1984

[30] Foreign Application Priority Data

Sep. 14, 1983 [FR] France ..... 83 14634

[51] Int. Cl.[4] ..... H01Q 3/00; F41G 00/00

[52] U.S. Cl. ..... 342/359; 89/41.09

[58] Field of Search ..... 343/359; 318/649; 244/3.2; 248/182, 183; 89/41.09; 33/275 G, 236, 316

[56] References Cited

U.S. PATENT DOCUMENTS

| | | | |
|---|---|---|---|
| 2,700,106 | 1/1955 | Taylor | 343/359 |
| 3,398,341 | 8/1968 | Dooley et al. | 318/649 |
| 4,035,805 | 7/1977 | Mobley | 318/649 |
| 4,143,312 | 3/1979 | Duckworth et al. | 318/649 |
| 4,158,261 | 6/1979 | Auer | 33/318 |
| 4,393,597 | 7/1983 | Picard et al. | 89/41.09 |

*Primary Examiner*—Theodore M. Blum
*Assistant Examiner*—David Cain
*Attorney, Agent, or Firm*—Larson and Taylor

[57] ABSTRACT

The device, which can be used on merchant vessels having only a course reference, comprises on a base (18) a mounting having bearing orientation means and supporting a gyroscopic assembly with two degrees of freedom, whose outer cardan transmission (28) has an axis of rotation (axis X) perpendicular to the bearing axis, its inner cardan transmission (36) having an axis of rotation (axis Y) at right angles to the axis X and being connected to the antenna during aiming. The gyroscopic assembly comprises a single flywheel (41) of considerable kinetic force in relation to the inertia of the antenna (10). Each cardan transmission has a torque motor (30,38) controlled by a loop whose feedback signal is delivered by an orientational pickup (40, 32) of the other cardan transmission. The means (24, 42, 46, 20) for orientation around the bearing axis are adapted to ensure substantially the aiming of the antenna in bearing, and therefore to retain the gyroscopic assembly close to the canonical position.

12 Claims, 6 Drawing Figures

DEVICE FOR STABILIZING AND AIMING AN ANTENNA, MORE PARTICULARLY ON A SHIP

BACKGROUND OF THE INVENTION

1. Field of the Invention

The invention relates to the stabilisation and aiming of antennas, more particularly satellite telecommunication ship mounted antennas, on ships at sea subjected to accelerations and angular movements of large amplitude compared with the acceptable tolerance as regards the aiming of the antenna.

In this respect it should be remembered that the various types of antennas whose use is recommended by international telecommunication organisations have very various characteristics as regards mass and inertia on the one hand, and the required aiming accuracy on the other. In all cases the device for stabilising and aiming the antenna must take into account features specific to the antenna selected.

2. Description of the Prior Art

For a long time many solutions have been proposed for the problem of stabilising and aiming members borne by a ship. Some of these solutions, for example, those adopted for long-distance aiming devices and the guns of warships, are highly complex and require course and vertical references to be available. They cannot be transferred to merchant vessels because of their high cost and the absence of a vertical reference, since as a rule the gyrocompass of a merchant vessel supplies only a course reference.

However, in the recent past antenna-stabilising devices have been proposed which are specifically intended for maritime telecommunication by satellite. They include the one described in the Paper by M. B. Johnson entitled "Antenna control for a ship terminal for MARISAT" (IEEE Conference Publication No 160, 7-9 March 1978); this is of the kind comprising, on a base, a mounting having bearing orientational means and supporting a gyroscopic assembly with two degrees of freedom, whose outer cardan transmission has an axis of rotation (axis X) perpendicular to the bearing axis, its inner cardan transmission having an axis of rotation (axis Y) at right-angles to the axis X and being connected to the antenna during aiming.

The device disclosed in this Paper whose type is at present known as "X-Y bearing", uses for stabilisation two gyrometers mounted on the rear of the antenna, and adapted to stabilise the axes X and Y respectively. However, the device requires a vertical reference for the X axis, which is obtained by means of an accelerometer or an inclinometer mounted on the bearing axis. The voltage delivered by the accelerometer or inclinometer is subtracted from the measurement of the orientation in situ of the X Axis. The angle of elevation can be obtained only by means of a filter with a high time constant.

Clearly, these particular features mean that the device is not very satisfactory for use on merchant vessels of low tonnage, whose equipment must remain economic.

Mountings have also been proposed with four axes, comprising a platform stabilised around rolling and pitching axes by a hanging assembly and two flywheels. The aiming device is separate in that case. It is carried by the platform and enables the antenna to be orientated around the conventional azimuthal and elevational aiming axes. Clearly, such an arrangement is extremely complex. Yet another arrangements uses a triaxial mounting of the "X, Y, bearing" type, but has two flywheels each having its own cardan transmission, thus considerably increasing costs and space occupied.

BRIEF SUMMARY OF THE INVENTION

It is an object of the invention to provide a device of the "X-Y a stroke bearing" kind which, although it is very simple and economical, enables the required aiming and stabilisation to be ensured for antennas whose mass and inertia are those currently used. To this end, to ensure stabilisation and aiming, the invention uses only one flywheel in conditions such that the nutation which appears in response to the torques applied and the movements of precession resulting therefrom to orientate the antenna takes the form of a parasitic movement which remains within the limit of acceptable tolerances.

More precisely the invention relates to a stabilizing and aiming device of the kind specified, wherein the gyroscopic assembly comprises a single flywheel of considerable angular momentum in relation to the inertia of the antenna, each cardan transmission has a torque motor controlled by a loop whose feedback signal is delivered by an orientation pick up of the other cardan transmission, and the means for orientation around the bearing axis are adapted to ensure substantially the means aiming of the antenna in bearing, and therefore to retain the gyroscopic assembly close to the canonical position.

In general, unless the kinetic force of the flywheel is very great in relation to the forces of inertia around the cardan transmission axes, each of the servocontrol loops will comprise means for filtering predetermined characteristics as a function of the moments of inertia of the cardan transmissions, the parameters of the angular movements applied to the base, and the required aiming accuracy. Such filter means can more particularly be formed by phase-delaying networks having a time constant considerably greater than the period of the stresses applied, (more particularly the period of the sea swell).

The means for orientation around the bearing axes can comprise a rotation motor with step-down transmission, advantageously via an irreversible connection, and a circuit for control as a function of the course and of the displayed value of the aximuth of the satellite, while the loop associated with the inner cardan transmission receives a correctional signal taking bearing variations into account, the deviation Gis and y being measured by the angle detector 40. The automatic control of y therefore forces it to follow the bearing direction and to maintain the canonical position.

In practice the device will in general comprise a computer for working out an elevation representing signal, applied to the servocontrol loop of the first cardan transmission, and an aximuthal signal, applied to the circuit for controlling bearing orientation, on the basis of the course and the longitude and latitiude of the vessel (ship in general) carrying the antenna. Automatic tracking is then ensured by sending signals correcting the deviations $\Delta x$ and $\Delta y$, which are superimposed on the calculated azimuthal and elevational information to cancel out all errors, including a heeling error. This enables the calculated direction to be maintained very close to the direction of the satellite, if the signal received should be lost, for example, by masking effect or fading. This prevents unsteadiness in the direction of the antenna, which would operate in open loop. A more rudimentary solution comprises simply means for displaying the azimuth and elevation determined by means of a separate computer, which can be an extremely simple one, since all that it must do is perform ordinary trigonometrical calculations.

In a modified embodiment, the antenna has a rotational symetry and is not only connected to the flywheel for aiming, but is also rigidly connected to the flywheel or substituted therefore, so that its angular momentum contributes towards or ensures stabilization.

Lastly, it should be noted that the device according to the invention is suitable for extremely various configurations, more particularly to take into account the kind of antenna used (parabolic, four helixes, . . . ); more particularly, it is not indispensable for the X and Y axes to be concurrent.

The invention will be more clearly understood from the following description of non-limiting exemplary embodiments thereof with reference to the accompanying drawings.

DETAILED DESCRIPTION OF THE DRAWINGS

Figure 1:
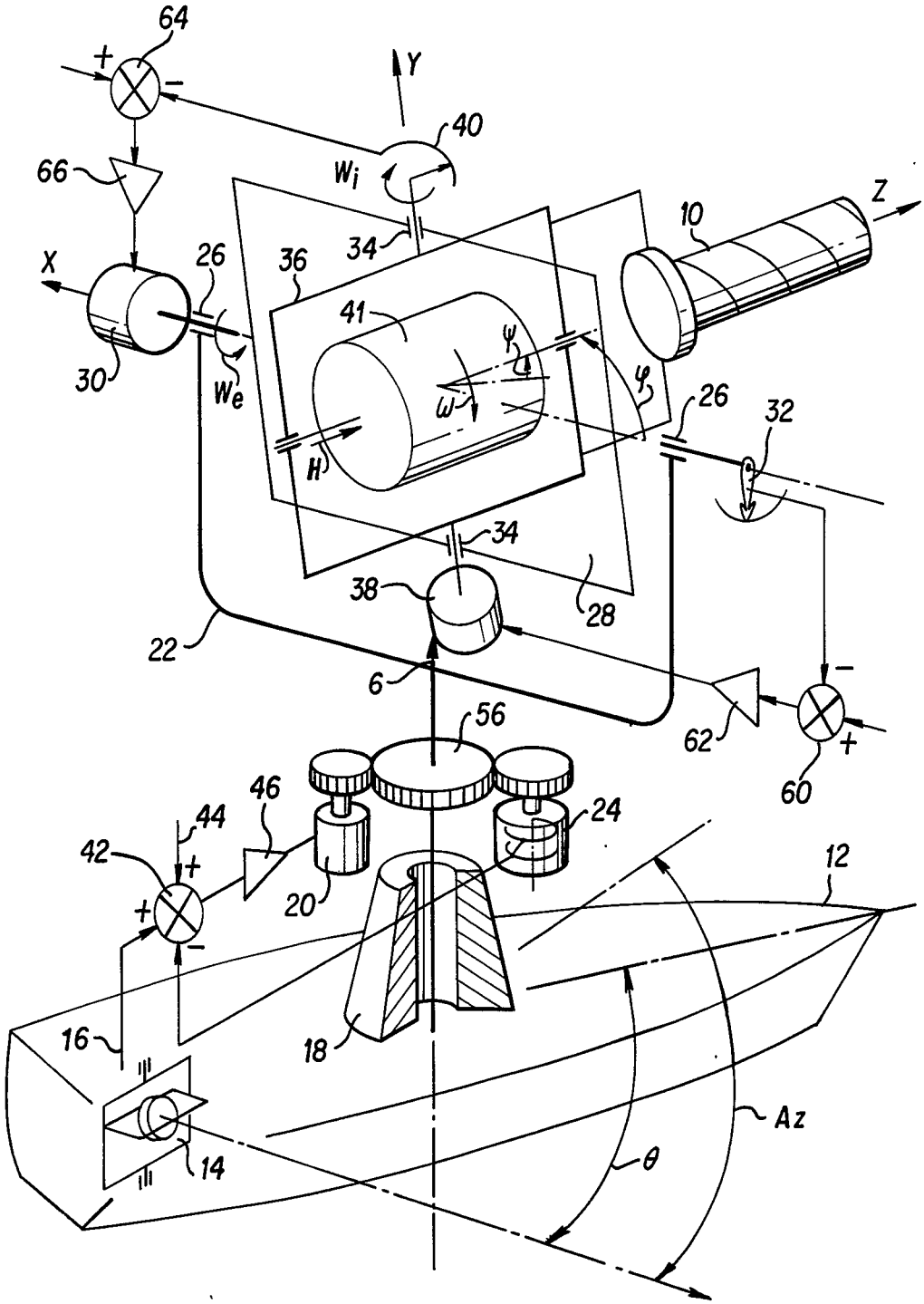
FIG. 1 is a schematic diagram showing the essential components of an embodiment of the stabilizing device intended for the stabilization and aiming of an antenna on a ship.

The device for controlling and aiming a helical antenna 10 of sighting axes Z, shown schematically in FIG. 1, is intended for use on a vessel 12 having a gyrocompass 14 supplying a course reference (angle $\theta$ between the line of travel of the vessel and geographical North) to an output 16. The device comprises a mounting of the "X-Y bearing" type. The mounting comprises a base 18 attached to the vessel and carrying bearings or pivots defining a bearing motor having a axis G around which a bearing step-down gearing 20 can rotate a unit 22 whose orientation is represented by the output signal of a bearing detector 24. The unit 22 is rigidly connected to the casing of a gyroscopic system and therefore supports via bearings 26 defining an axis X (axis of elevation), perpendicular to the bearing axis G, an outer cardan transmission 28 having a torque motor 30 and an orientation detector 32. The outer cardan transmission supports, via bearings 34, defining an axis Y at right angles to the axis X, an inner cardan transmission 36 having a torque motor 38 and an orientation detector 40. In the embodiment illustrated in FIG. 1 the antenna 10 is attached to the inner cardan transmission 36.

Rotating in the inner cardan transmission 36 is a gyroscopic flywheel 41 driven at a constant speed $\omega$ by a motor (not shown) around the sighting axis Z, so as to have an angular momentum $\vec{H}$, which, as will be seen hereinafter, must have a minimum value in dependance on the inertia of the antenna and the degree of stabilisation required.

The flywheel 41 and the antenna 10 are so disposed that the cardan transmission are in static equilibrium.

Having arrived at this stage of the description, it may be advantageous to recall a few facts about the properties of a free gyroscope with two degrees of freedom, such as that formed by the flywheel 41 and its supporting cardan transmissions.

The direction of the angular momentum $\vec{H}$ can of course occupy any direction in space, and remains in indifferent equilibrium, whatever the accelerations undergone may be, apart from the friction of torques in the bearings. The sum of the external torques is zero and the direction of the angular momentum $\vec{H}$ remains fixed in absolute space.

However, this property exists only on condition that displacements do not bring the axis X parallel to $\vec{H}$, since in that case one degree of freedom is lost in this so-called "forbidden" configuration.

In the case of direct mounting with two degrees of freedom on a vessel which can follow any course, clearly when $\vec{H}$ is horizontal, the turning of the vessel around its yaw axis might produce the forbidden configuration. This situation is prevented according to the invention by so orientating the moveable unit around the bearing axes G as to give such unit 22 substantially the site or bearing aiming for which the cardan transmissions are in the canonical position (the axes X, Y and Z defining a trirectangular trihedron) when the vessel is in its normal attitude.

For this purpose the step-down gearing 20 is controlled by an aiming loop which comprises an adding circuit 42 adapted to combine the signals received;

- from the output 16 of the gyrocompass 14, indicating the course $\theta$ of the vessel,
- from an input 44 displaying the bearing in the normal attitude of the vessel,
- from the bearing detector 24, which delivers a feedback signal.

The signal worked out by the adder 42 is taken by an amplifier 46 to a level adequate to actuate the step-down gearing 20.

Incidentally, it should be noted that the step-down gearing 20 advantageously has a step-down ratio adequate to be irreversible. In these conditions the torques which may create the horizontal accelerations given to the vessel have no effect on orientation around the bearing axes G.

As already pointed out, aiming is performed by using the precession of the flywheel 41 of the gyroscopic assembly. In this respect it must be remembered that the application by motor 38 of a torque $C_i$ to the inner cardan transmission of a gyroscope with two degrees of freedom causes a precession of the outer cardan transmission around the axis X at a speed $\omega_e$ $$\omega_e = C_1/H \text{ Sin } \phi$$

i.e., a variation in the elevational aiming angle $\phi$ in relation to the horizontal—namely a rotation around the axis X.

The effect of a driving torque $C_e$ applied by motor 30 can be broken down into two actions:

- a component normal to the plane of the outer cardan transmission 28 and absorbed by the bearings 26
- a component normal to the plane of the inner cardan transmission, equal to $C_e/\text{Sin } \phi$, which causes the precession of the inner cardan transmission at a speed $\omega_i$ and which is balanced by the gyroscopic torque H $\omega_i$.

This reminder may be summed up by stating that the application of a torque to one of the cardan transmissions modifies the direction of the other cardan transmission by precession, so that the direction of the angular momentum $\vec{H}$ can be aimed in any given direction by applying a torque to one cardan transmission or the other.

However the foregoing explanations suppose that the cardan transmissions are perfectly balanced and that the flywheel remains perfectly fixed in space. In reality it is impossible to cancel out completely imbalances in all positions and to avoid the effects of anisoelasticity. The results is an aiming drift or displacement which must periodically be made good.

Moreover, the foregoing details suppose that the movement of precession is established. However a transitory phase exists between the application of the torque and the appearance of an angular speed of precession. Calculations show that when a torque is applied, a periodical nutational movement appears with a frequency $\omega_0$. If, for example, a torque $C_e$ is instantaneously applied to the outer cardan transmission, the following are superimposed on the movement of precession:

- a variation in the angle $\beta$ between the direction of the inner cardan transmission and X, with an amplitude $\beta max = C_e\ I_1/H^2$ ($I_1$ denoting the inertia of the inner cardan transmission 36 around its axis of rotation Y),
- a nutational movement of the inner cardan transmission, with a frequency $\omega_0$ and a maximum aplitude $C_e/H\omega_0$.

As can be seen, to limit the amplitude of nutation, the value of the torques $C_e$ and $C_1$ will have to be limited to a low value, and this will imply a low aiming speed (of the order of a few degrees per second in practice), and the angular momentum $\vec{H}$ will have to be given as high a value as possible.

As a rule the telecommunication antenna of a ship is mounted in the superstructures, so as to have a free sighting field. For example, it is mounted at the mast head. The mounting is therefore subjected not only to the angular movement of rolling, pitching and yawing, but also to periodical accelerations of lifting, lurching and horizontal acceleration. In practice the rolling and pitching amplitude may be as high as ±30°.

Now that these conditions of use have been defined, we shall examine how stabilisation and aiming are achieved, and the conditions which must be met to obtain the necessary accuracy.

Stabilisation:

The antenna is stabilized passively by the gyroscopic stiffness of the flywheel 41. If the cardan transmissions are balanced—i.e., the centre of gravity of each rotating assembly is on its axis—accelerations and angular movements cause no torque, and all that remains is a residual periodic precession of zero mean value during a sufficiently long time as compared to the period of rolling and pitching. This precession, which forms on aiming error, retains a very low value if the angular momentum $\vec{H}$ is fairly high. In practice, since the required precision does not exceed a few degrees, such oscillation is not very troublesome.

However, it must be noted that the angular detectors 32 and 40 measure the movement of the cardan transmissions implied by stabilization, while the casing is subjected to rolling and pitching which may reach ±30°. To avoid the appearance of a periodic parasitic precession caused by the actuation of the motors 30 and 38, the output signal of the detectors 32 and 40 must be filtered, unless the time constant of the gyroscopic system is high enough for the parasitic precession to remain below the required accuracy. In the case shown in FIG. 2 each detector 32 or 40 is followed by a filter formed by a phase-delaying network 48 or 50, which can have a time constant of the order of 1 minute. In this way, all that is left in the output signal of the X angular detector 32 is the component representing the mean angle of elevation, the components due to rolling and pitching being removed from the detector output signal. However, a heeling error may remain which is corrected by automatic tracking operation.

Stabilization around the bearing axis in the case of a yawing or turning movement of the vessel is ensured in response to changes in the signal emitted by te gyrocompass and representing the course 8 of the vessel.

Aiming:

The object of aiming the antenna is to keep it directed towards the satellite, so that it must be aimed each time the direction of the satellite changes in relation to the vessel, as the result of a change in the position of the vessel and/or a change in course.

As a rule the direction of the satellite is defined by its azimuth and elevation. The azimuth Az is the angle in the horizontal plane between the direction of the satellite and geographical north. The elevation E1 is the angle formed in the vertical plane by the direction of the satellite and the horizontal. These two angles are a function of the longitude Lo and the latitude La of the vessel. The embodiment illustrated in FIG. 2 comprises a computer 52 for working out the azimuthal angle Az and the elevational angle E1 of the satellite as a function of stored data concerning the position of the satellite, which is generally stationary in relation to the earth, and input data formed by the course $\theta$ coming from the gyrocompass 14 and by the longitude and latitude, introduced by display. Working out Ax and E1 requires only conventional trigometrical calculations, which need not be described here.

The output signal Az formed, for example, by a voltage proportional to the azimuthal angle, is applied to the adder 42, which also receives the feedback signal from the detector 24. The resulting error signal is sent to amplifyer 26 via a phase advance correctional network 54 which enables the performances of the bearing control system to be improved to a certain extent.

In practice the detector 24 can be formed by a multiturn potentiometer coupled via a step-down gearing to a toothed wheel 56 rigidly connected to the unit 22 and meshing with the output pinion of the motor with step-down gearing 20.

Clearly, there is a time delay between two successive displays of the vessel's position (longitude and latitude). The movement of the vessel therefore produces an increasing error between the position displayed and the actual position. In the embodiment illustrated in FIG. 2 such error is corrected by automatic tracking means which comprise a distance-measuring device 58 delivering output voltages ΔX and ΔY corresponding to the correction of the elevational error and the correction of the azimuthal error respectively. The control loop of the torque motor 38 of the inner cardan transmission therefore comprises an analog adder 60 which receives the signals E1 and Δx, as well as the filtered feedback signal coming from the detector 32. The output signal is amplified in a double quadrant amplifier 62 or applied to a polarized relay to control the motor 38. Similarly, the control loop of the torque motor 30 comprises, in addition to the detector 40, an adder 64 and an amplifier 66. However the operation of the motor will always have the objective of merely limiting the deviation of the inner cardan transmission 36 in relation to the canonical position at a low valve, the azimuthal orientation being mainly ensured by the step-down motor 20. During the always slow azimuthal rotation, the detector 40 delivers a signal which operate the motor 30 and maintains the aiming of the antenna 60.

The device can be complemented by means 68 for observing the real values of bearing and elevation given to the antenna, such means being formed by volt meters displaying the output voltages of the detectors 32 and 40, if necessary after filtering.

When the three control loops are thus closed, the flywheel is fixed in relation to space—i.e., to the satellite which is stationary in relation to earth.

Figure 2:
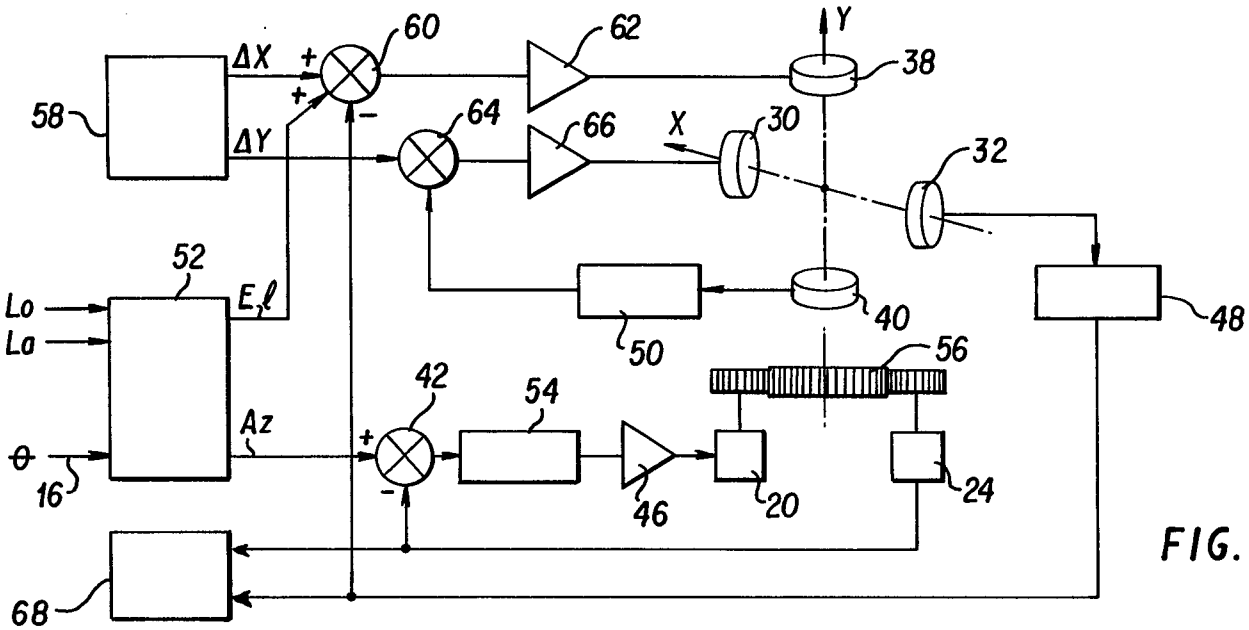
FIG. 2 is a schematic diagram of the servocontrol circuits of the device shown in FIG. 1, FIG. 3, similar to part of FIG. 2, shows a simplified embodiment.
Figure 3:
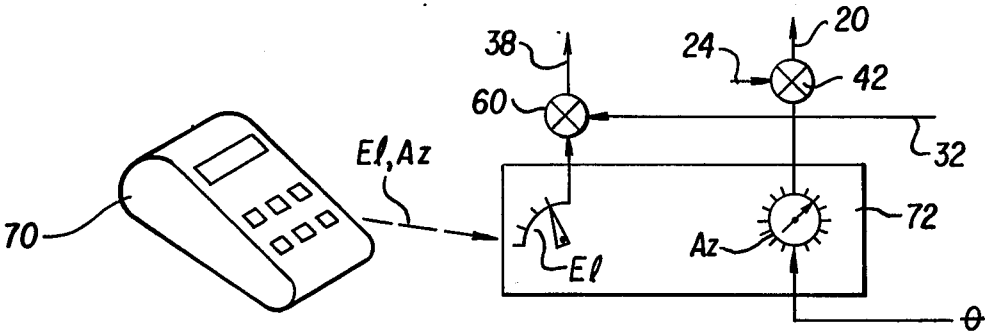

Instead of the device shown in FIG. 2, a simplified, highly economic, version can be used such as that shown in FIG. 3, which has no computer for working out the azimuth and elevation. These values must be calculated off-line, for example, by means of a programmed calculator 70, when displayed on a desk 72 which is substituted for the computer 52, the rest of the assembly remaining unchanged.

The object of bearing aiming is to avoid the occurrence of the forbidden configuration. At low elevations—i.e., in conditions in which the forbidden configuration may occur, the Y axis is almost vertical, and the fixity of the flywheel subsequently corrects the bearing error caused, for example, by errors due to the kinematics of the carden transmissions in heavy seas.

The actual make up of the mechanical parts of the device particularly adapted to different kinds of antennas which differ in mass, inertia, and the aiming accuracy which they require will now be described;

The mass of the antenna is not negligible and, to balance the cardan transmissions, it will be advisable to displace the flywheel in relation to the X and Y axes, rather than to add large additional masses, which considerably increase inertia. However, controllable weights will in general be provided for obtaining fine equilibrium around the X and Y axis, although a balancing residue is tollerable, since all drifts in the position of the gyroscopic system are detected in the angular detectors 32 and 40 when the control loops are closed.

Inertia of the antenna acts on stability and frequency of nutation, and any increase in such inertia, for a given stability, demands an increase in the angular momentum $\vec{H}=I_{\omega}$ of the flywheel (I being the moment of inertia of the flywheel). This action will bring the antenna of the X and Y axes of rotation as close together as possible, to reduce inertia. However, in spite of this, any increase in the dimensions of the antenna, for example, to increase its directional properties, must be accompanied by an increase in the angular momentum $\vec{H}$.

Such increase can be obtained by raising the speed $\omega$ of the flywheel, this having the advantage of introducing no further inertia. However, in practice, at least if the bearings used are ball bearings, obtaining a satisfactory service life (about 50,000 hours) means that a speed of about 6000 r.p.m. must not be exceeded. The result is that the size of the flywheel must be increased, but then centrifugal force forms a limiting factor, since in practice the circumferential speed must not exceed 120 m/sec.

Consequently, at least when conventional bearings are used, the device according to the invention enables only antennae of medium size to be stabilized, whose diameter does not exceed 1 m in the case of a parabolic antenna. In the case of a flat antenna with phased network, large dimensions can be accepted, due to the reduced inertia.

Of course larger dimensions can be obtained if use is made of magnetic bearings with active suspension of hydrodynamic bearings, which enable high flywheel speeds to be adopted.

Two devices will now be described by way of example; one intended for aiming an antenna with four helixes, the other being for the aiming of a parabolic antenna.

Figure 4:
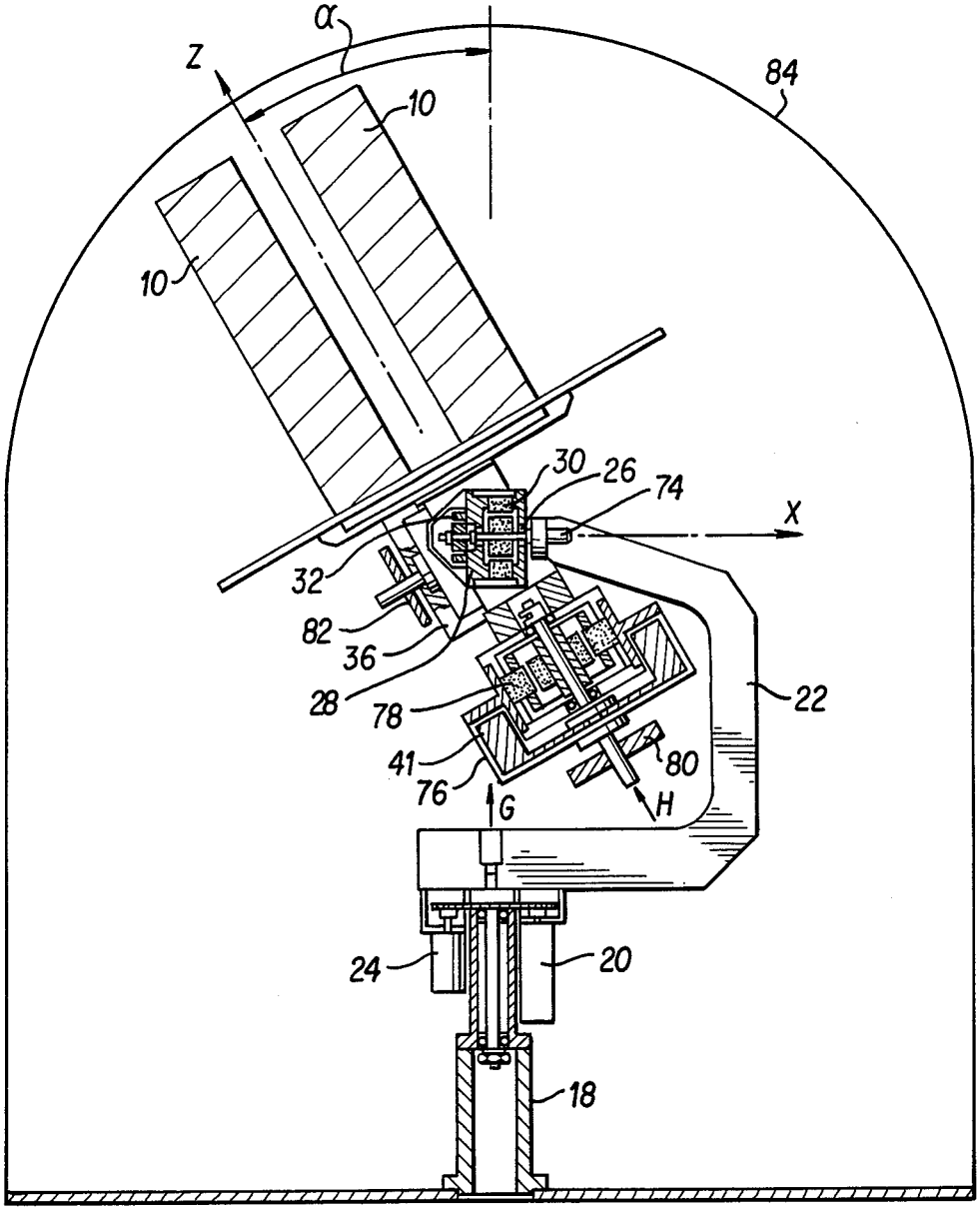
FIGS. 4 and 5 show two mechanical arrangements of the mechanical elements of the device according to the invention, in section along a plane of symmetry.

FIG. 4, in which like members to those in FIG. 1 have like references, shows the device for orientating an antenna 10 with four helixes when the antenna is aimed at the zenith on a vessel whose rolling and pitching take the form of an inclination $\alpha$ of the axis of radioelectric sighting Z in relation to the axis G, in the plane GX. FIG. 3 shows again the movable unit 22 formed by a bearing ring rotating in bearings provided in the base 18. The ring 22 bears the cardan transmission 28 which can be orientated around the X axis by means of a spindle 74 and bearings 26. The cardan transmission 26 which can be orientated around the Y axis, rotates on the cardan transmission 28 in bearings which are not shown in the figure. It can be seen that the "outer" cardan transmission 28 is therefore accommodated inside the "inner" cardan transmission 36, thus simplifying mechanical manufacture. The torque motor 30 is located directly around the spindle 74.

Attached to the cardan transmission 36 are the antenna 10 and the casing 76 containing the flywheel 41 and its driving motor 78 (a hysteresis motor, for example). The antenna 10 and the flywheel are disposed on either side of the Y axis, so as to be approximately balanced, which can be made perfect by means of a controllable weight 80 for Y axis balance. Another weight 82, whose position on the cardan transmission 36 can be controlled, enables Y balancing to be performed.

In this arrangement the axis X, Y and G are concurrent, and this enables the protective radome 84 of the antenna to be given a value close to its minimum theoretical value.

An arrangement of this kind can be adopted for a standard B antenna of the IMMARSAT project, or an M5 antenna of the project PROSAT, adapted to provide a gain of about 15 dB at 1.5 GHz and requiring an aiming accuracy of 6°. A precision of ±1.3° can be maintained up to rolling-pitching angles of ±30° for a mounting disposed 30 m from the axis of rolling, without mounting any correctional network at the output of the angular detectors 32 and 40, with an antenna weight, combined with the flywheel, not exceeding 3.8 kg, the flywheel having a moment of inertia of 4.82 kg. $m^2$/sec rotating at 6000 mn.

Figure 5:
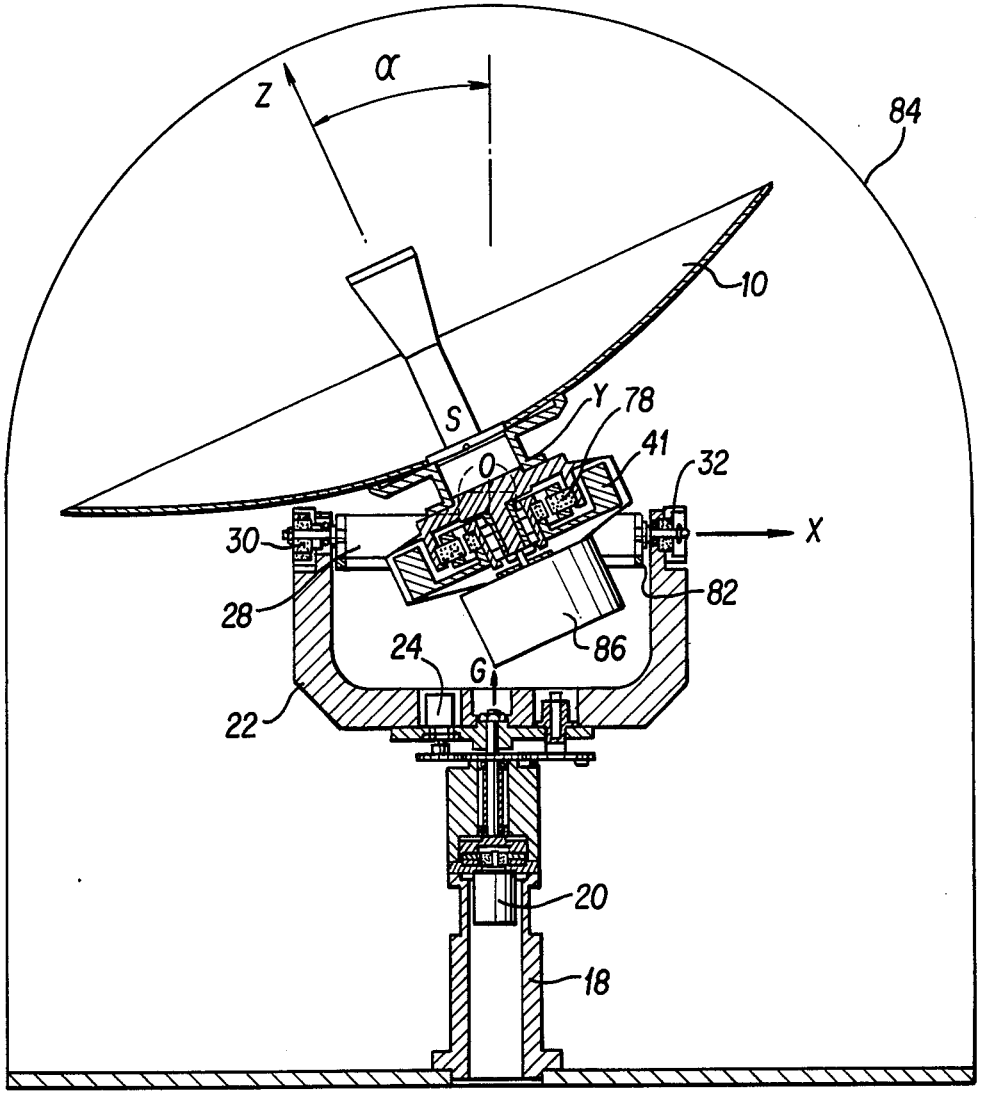

The embodiment illustrated in FIG. 5, in which like members to those shown in FIG. 4 have like references, is adapted for the aiming and stabilization of a parabolic antenna giving a gain of 20 dB at 1.5 GHz, requiring an accuracy of ±2°. Since the inertia of this antenna is higher than that of the antenna envisaged in relation to FIG. 3, the flywheel 41 must have 17 kg. $m^2$/sec for a weight for 5.5 kg.

The arrangement shown in FIG. 5 mainly differs from that shown in FIG. 4 by the feature that the X and Y axis are not concurrent, thus enabling the inertia of the assembly to be reduced while maintaining the same maximum rolling angle $\alpha$, since if the X axis had intersected the Y axis at the point 0 (FIG. 4), the distance OS between the Y axis and the bottom of the antenna would have had to be lengthened, thus considerably increasing inertia, which increases as twice the square of such distance. On the other hand, an additional balancing mass, which can be contained in the equipment compartment 86, must be disposed on the lower face of the outer cardan transmission 28 to bring the centre of gravity of 0. The required accuracy can be obtained by means of a flywheel rotating at 3000 r.p.m. and having a kinetic force of 18 kg.m$^2$/sec, rotating in prestressed ball bearings.

Other embodiments of the invention are possible; more particularly, in the case of an antenna of revolution, the antenna can be used as a flywheel, to complete the action of the flywheel 41 in FIG. 1 or as a substitute therefor.

Figure 6:
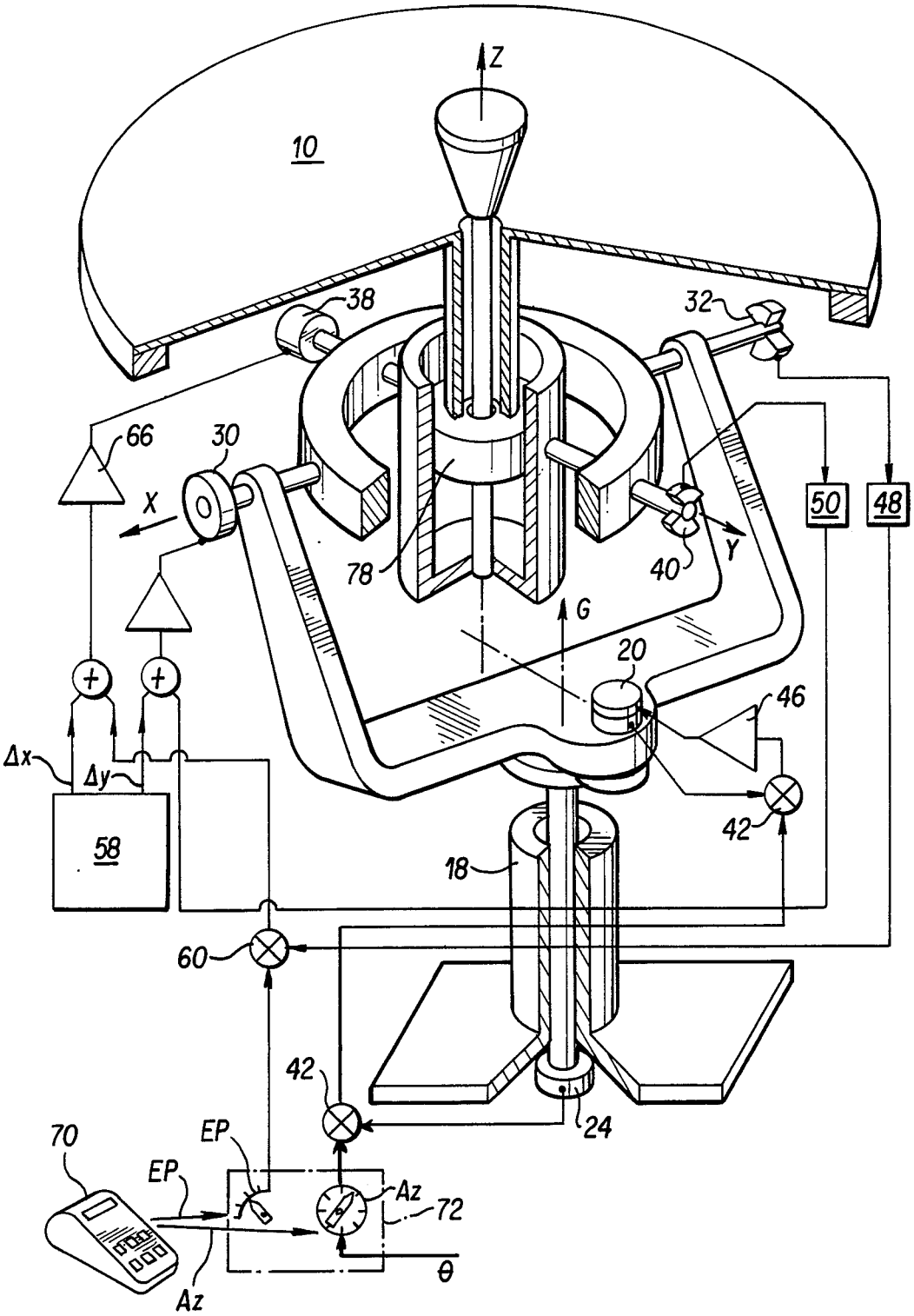
FIG. 6 shows another embodiment of the invention, in which the stabilizing flywheel is formed by the antenna rotating around its radioelectric sighting axis.

By way of example, FIG. 6 shows a device for stabilizing a parabolic disc antenna 10, in which the antenna, which is rotated by motor 78 around axis Z, is used as a stabilising flywheel. In that case, there is no need to use a rotating contact on the electrical junctions of the antenna with the fixed parts. In FIG. 6 the aiming device is of the kind shown in FIG. 3, and like references are used. This method can be used for antennas of small diameter. For example, a disc antenna 0.85 m in diameter rotating at an angular speed of 200 r.p.m. and having a kinetic force of 15 N.m.s. is envisaged.

Once again, to modify the position of the Z axis, gyroscopic precession is used, a torque applied around the X axis causing an output speed around the Y axis, and conversely. it will be noted that in the embodiment illustrated the Z axis is offset in relation to the bearing axis G, and does not coincide therewith when the antenna is sighted at the zenith.

What is claimed is:

1. A device for stabilising and aiming an antenna on a ship, comprising, on a base, a mounting having bearing orientational means and supporting a gyroscopic assembly with two degrees of freedom, whose outer cardan transmission has an axis of rotation X perpendicular to the bearing axis, the inner cardan transmission having an axis of rotation Y at right-angles to the axis X and being connected to the antenna during aiming, wherein the gyroscopic assembly comprises a single flywheel of considerable, angular momentum in relation to the inertia of the antenna, each cardan transmission has a torque motor controlled by a loop whose feedback signal is provided by an orientation pick up of the other cardan transmission, and the means for orientation around the bearing axis are adapted to substantially provide the mean aiming of the antenna in bearing, and therefore to retain the gyroscopical assembly close to the canonical position.

2. A device according to claim 1, wherein each of the servocontrol loops comprises low-pass filter means of characteristics determined as a function of the angular momentum of the flywheel, the parameters of the angular movements applied to the base, and the required aiming accuracy.

3. A device according to claim 2, wherein the filter means are formed by phased-delay networks having a time constant which is much higher than the period of the stresses applied.

4. A device according to claim 1, wherein the means for orientation around the bearing axis comprises a step-down transmission for rotation via an irreversible connection, and a circuit for control as a function of the course and of the displayed value of the azimuth of the satellite, while the loop associated with the inner cardan transmission receives a correctional signal taking into account variations in bearing and the difference delivered by the difference-measuring device.

5. A device according to claim 1, which comprises a computer which works out an elevational signal, applied to the servocontrol loop of the first cardan transmission, and an azimuthal signal, applied to the circuit for control of azimuthal orientation, on the basis of the course and the longitude and latitude of the vessel carrying the antenna.

6. A device according to claim 5, which comprises automatic tracking means whose differential signals between the direction of the satellite and the direction of the antenna are determined by a difference-measuring device which corrects the position of the programmed tracking given by the processor (azimuth and elevation), the signals being sent to the servocontrol loops of the second and first cardan transmissions respectively.

7. A device according to claim 1, which comprises means for displaying the azimuth and elevation determined by means of a separate computer.

8. A device according to claim 1 wherein the outer cardan transmission is disposed physically inside the inner cardan transmission.

9. A device according to claim 1, wherein the antenna and the flywheel are disposed along the sighting axis, on either side of the axis Y to produce approximate equilibrium.

10. A device according to claim 1, wherein the cardan transmission have controllable balancing weights.

11. A device according to claim 1 wherein the antenna is one of revolution and is rigidly connected to the flywheel, so that its angular momentum contributes towards stabilisation.

12. A device according to claim 1, wherein the axes X and Y are non-concurrent.

* * * * *